United States Patent [19]

Marino, Jr.

[11] 3,930,495

[45] Jan. 6, 1976

[54] INVALID EXERCISING DEVICE

[76] Inventor: Michael Marino, Jr., 1428 Chickasaw St., Metairie, La. 70005

[22] Filed: Aug. 15, 1974

[21] Appl. No.: 497,539

[52] U.S. Cl. ..... 128/25 R; 272/73

[51] Int. Cl.[2] ..... A61H 1/02

[58] Field of Search ..... 128/25 R; 272/73

[56] References Cited

UNITED STATES PATENTS

| | | | |
|---|---|---|---|
| 1,820,372 | 8/1931 | Blomquist | 272/73 |
| 2,020,992 | 11/1935 | Caplan | 128/25 R |
| 3,213,852 | 10/1965 | Zent | 128/25 R |
| 3,540,435 | 11/1970 | Smith | 128/25 R |
| 3,572,699 | 3/1971 | Nies | 128/25 R |

*Primary Examiner*—Lawrence W. Trapp

[57] ABSTRACT

A bicycle type of exercising device for paraplegic invalids comprising an elongated structure having one end adapted to rest upon the floor and its other end adapted to rest upon the end of a conventional bed. Handle bar means and seat support means are mounted upon the end resting upon the floor to provide a manual operator station. The latter end is also provided with a first bicycle sprocket which is operably connected by a link chain to a second sprocket operably connected to the other end of the elongated structure. The second sprocket means is provided with pedal means adapted to receive and retain the feet of a paraplegic who is horizontally disposed in the bed on which the present device is operably mounted whereby the invalid can pedal the present device alone, or preferably, his legs can be exercised by an operator pedaling at the other end provided with the manual station.

A preferred embodiment further comprises an auxiliary electric power source operably connected to the link chain for actuating the present device in the absence of manual operation by an operator.

An especially preferred embodiment is directed to an electric power driven only device having a supporting bicycle structure adapted for mounting solely upon the bedstead.

4 Claims, 6 Drawing Figures

INVALID EXERCISING DEVICE

BACKGROUND OF THE INVENTION

The present invention broadly relates to therapeutic exercising devices. More particularly, the instant invention provides a bicycle type of exercising device which is especially designed for use by paraplegic invalids who are essentially unable to exercise themselves.

A paralyzed person is one who has experienced a total loss or impairment of voluntary muscular power, whether from an organic disease, including injuries, or from psychiatric causes. The handicapped person who has experienced paralysis of both legs, paraplegia, whether due to organic causes such as a lesion below the cervical segments of the spinal cord, or from psychiatric causes, that is, a psychoneurosis, evidencing itself in the form of a motor symptom of paralysis of the legs, requires that the paralyzed limbs be manipulated. In the absence of physical therapy involving the progressive stretching and exercise of the legs, contracture of the tendons and muscles of the legs occur whereby atrophy sets in.

It is common practice in the treatment of paraplegics to manipulate their legs manually, however, the services of a masseuse is expensive where an invalid requires a considerable amount of attention. Consequently, countless types of mechanical exercising devices have been perfected in the art over the years for use by paraplegics, for example see U.S. Pat. Nos. 964,898 and 3,661,149. Needless to say, many of these devices are expensive to manufacture and/or are somewhat difficult to employ. Care must be exercised in preventing serious forms of injury to the invalid, for example, by the patient's legs or feet becoming displaced on the machine which is generally equipped with sufficient power actuated means to inflict serious injury to the feet or legs of the patient. Another distinct disadvantage of many of these prior art devices is the fact that they are also not very portable.

Among the unique advantages and features of the present invention is the provision of a bicycle type of exercising device which is very simple in construction and inexpensive to manufacture, very portable, and simple to employ by an operator in its initial setup and adjustment, as well as in its mode of operation to manipulate the legs of the paraplegic patient.

The above together with other features and advantages of the instant invention will be apparent to one skilled in the art in light of the details of construction and operation of the present bicycle type of exercising device as shown in the drawings and described in the ensuing detailed disclosure of its preferred embodiments which are particularly pointed out in the appended claims.

BRIEF DESCRIPTION OF THE DRAWINGS

In the two sheets of drawings illustrating the preferred embodiments of the present invention, synonymous reference numerals are employed throughout in the various views to refer to identical components.

DESCRIPTION OF THE PREFERRED EMBODIMENT(S)

Figures 1, 2:
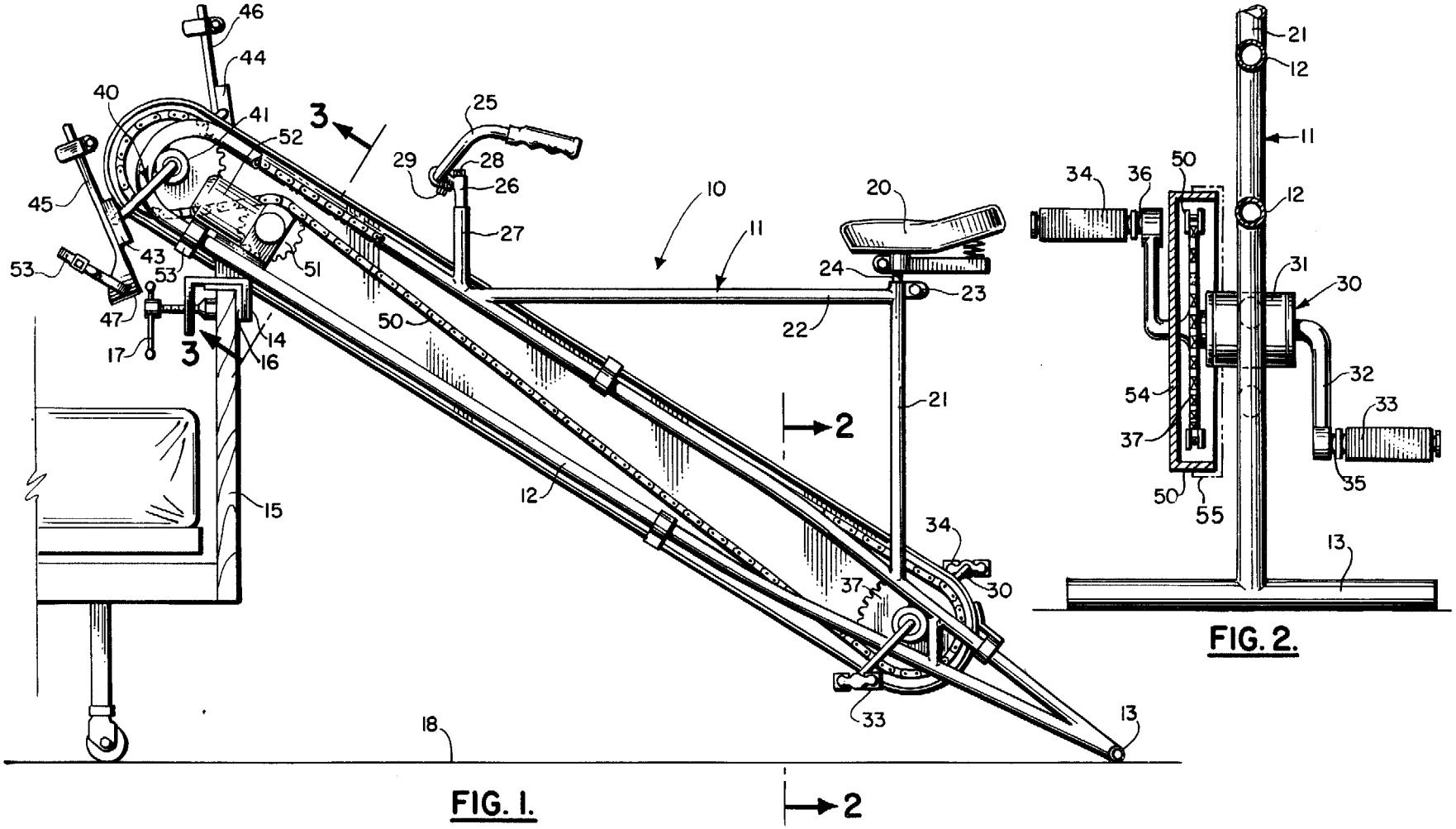
FIG. 1 in the drawings illustrates a side elevation view of the present bicycle type of paraplegic exercising device with the left hand side chain guard cover removed to reveal the internal mechanism.
FIG. 2 depicts a vertical section view taken along the line 2—2 of FIG. 1 showing the details of the lower sprocket assembly at the operator station.

Referring specifically to FIG. 1 of the drawings, the reference numeral 10 generally designates the bicycle type of exercising device of the present invention which comprises the tubular main frame assembly 11 which in turn comprises the elongated hair pin or U-shaped portion 12. The U-shaped portion 12 is provided at its lower end with the perpendicular split bar support member 14 as shown in greater detail in FIG. 2 of the drawings.

Figure 4:
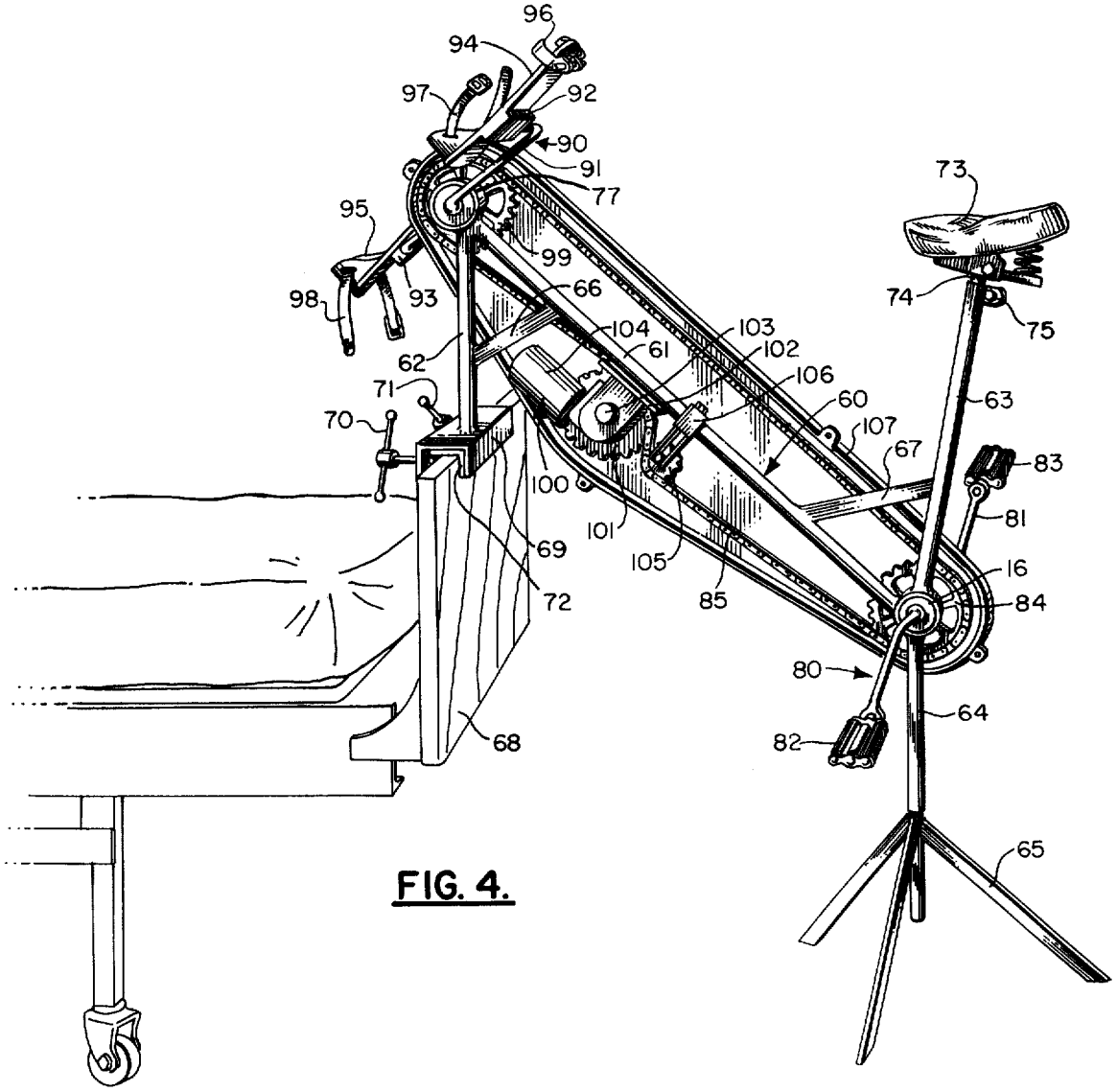
FIG. 4 of the drawings depicts a partial cutaway isometric view of yet another preferred embodiment of the present invention.

The top or upper end of the U-shaped frame support 12 is provided with the extended U-shaped or channel shaped support member 14, having the general configuration and length of the similar component as shown in FIG. 4 which is described in detail hereinafter. The channel member 14 can be of any suitable length, just so long as it is of sufficient length to stabilize and prevent the main frame assembly from rocking on the bedstead 15. Generally, the member 14 need only be approximately 1 foot in length. The channel 14 is provided with the resilient material 16 to prevent marring of the end board 15. The channel member 14 is suitably bored and threaded to receive the hand wheels or cranks 17, generally two being provided. The hand cranks are backed off sufficient to allow the channel member to bayonet over the top edge of the bedstead 15, after which they are tightened up to rigidly attach the top part of the frame assembly 11 to the bedstead, the bottom end of the elongated frame portion 12 resting upon the floor 18, thus allowing the present device to accomodate an evenness in the floor, as well as pivot about the bedstead 15 which minimizes the effects of vibrations and the like.

The present bicycle type of exerciser is provided with the conventional bicycle seat assembly 20 which is adjustably fixed to the location where the vertical upright frame member 21 and the horizontal member 22 are joined. The bolt assembly 23 is provided for tightening the top collar portion of the upright member 21 on the support shaft 24 of the seat 20.

The frame assembly 11 is also provided with the conventional bicycle handlebar assembly 25 which is adjustably fixed to the yoke 26 which in turn bayonets within the handlebar upright portion 27 of the frame 11, being secured therein by virtue of the lock nut 28 in the manner well known in the art. The handle bar assembly 25 is adjustable relative to the yoke member 26 by virtue of the lock nut 29 as is also conventional in the art.

The elongated frame assembly 12 is adapted to receive the first or lower sprocket assembly 30, which referring together to FIG. 2, is shown in greater detail therein. The sprocket assembly 30 further comprises the bearing support hub 31 which rotatably supports the pedal and sprocket assembly 32. This is accomplished in the manner well known in the bicycle arts whereby the pedal assembly 32 is rotatably mounted within the hub 31 by virtue of a pair of opposing ball bearings (not shown). However, a conventional sleeve assembly relationship could be employed, in short, any manner of rotatably suspending the pedal assembly 32 within the hub 31 can be employed. The pedals 33 and 34 are rotatably connected to the sprocket pedal member 32 by virtue of ball bearing assemblies (not shown) rotatably mounted within each of the pedals 33 and 34 which thereby rotate about the support shafts 35 and 36 respectively, thus assuming the plane established along the bottom of the operator's foot at all times, as is also conventional in the bicycle and related arts.

The pedal assembly 32 further comprises the sprocket member 37 which is centrally rigidly affixed to the shaft member 32. The hub portion 31 in turn is rigidly affixed, such as by welding, to the top member of the elongated frame portion 12 and the rib support 37 which spans the top and bottom portions of the frame 12.

Figure 3:
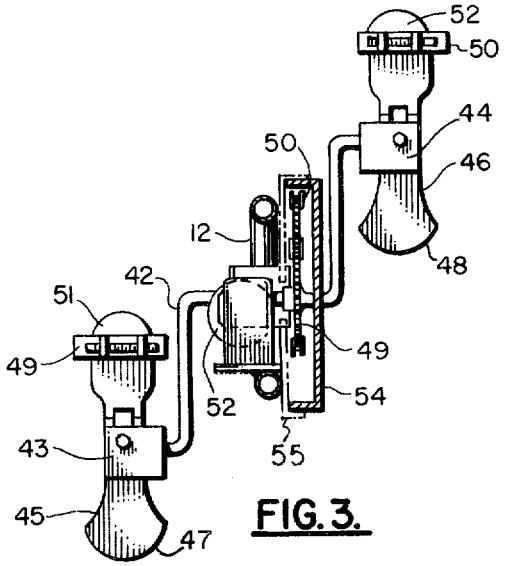
FIG. 3 depicts a sectional view taken along the line 3—3 of FIG. 1 with respect to the longitudinal axis of the drive mechanism of the present device.

Operably affixed to the top U-shaped portion of the hair pin frame assembly 12 in the upper or second sprocket assembly means 40. Referring together to FIG. 3, the top sprocket assembly 40 is essentially identical to the lower sprocket assembly 30 with minor differences.

The top sprocket assembly 40 further comprises the mounting hub portion 41 which is rigidly affixed to the inside curved portion of the U-shaped end of the elongated frame assembly 12 in any conventional manner, such as welding. The pedal and sprocket assembly 42 is rotatably mounted within the hub portion 41 by virtue of ball bearing means or the like as is conventional in the bicycle arts as discussed above with regard to the similar sprocket assembly 30. The sprocket assembly 40 further comprises the pedal members 42 and 44 which are rotatably affixed upon the pedal shaft 42. The foot retaining members 45 and 46, which are rigidly affixed to the respective pedals 43 and 44, are provided for retaining and supporting the feet of the paraplegic patient who is undergoing treatment by way of the present device. The assemblies 45 and 46 are similar to the top portion of a conventional skate, being provided with the heel rest portions 47 and 48 wherein the heel of the paraplegic's shoe is placed and secured, in part, by virtue of the adjustable clamp assemblies 49 and 50 which are screwed together by a key (not shown) which operably connects to the threaded members 51 and 52 respectively. The latter are provided with opposing threaded portions whereby rotation thereof will cause their mating clamp or jaw portions to simultaneously move inwards or outwards relative to each other upon rotation of said threaded shafts. The paraplegic's foot is further retained within the respected shoe support assemblies 45 and 46 by virtue of the strap assembly 53 as shown in FIG. 1 (only one strap shown).

The top pedal assembly 42 further comprises the sprocket portion 49 which is centrally mounted thereon in longitudinal alignment with the sprocket portion 37 of the lower or first sprocket assembly 30. The sprocket assemblies 30 and 40 are operably connected to each by virtue of the link chain 50 which is of sufficient length to pass over the peripheral spokes of each of the sprocket members 37 and 49. The link chain 50 further serpentines over the sprocket member 51 which is operably connected to the electric motor means 52. The electric motor means 52 provides an auxiliary source of power so that the present paraplegic exercising device can be employed by a paraplegic patient in the absence of the assistance of the human operator to perform the physical therapy. The electric motor 52 is rigidly fastened to the hair pin frame assembly 12 by the bracket 33 such that the sprocket 51 is also in alignment with the sprockets 37 and 49. The sprocket and link chain assembly is operable encased within a chain guard comprising the right hand portion 54 and the left hand portion 55 (shown only by dashed lines in FIGS. 2 and 3).

By way of operation, the present paraplegic bicycle type of exercising device, being extremely portable whereby it can be readily moved from one location to another, is placed at one end of the bed and the clamp assembly 14 is attached to the bedstead or foot board 15 of the bed. The paraplegic patient to undergo physical therapy is then placed on his back in the bed in a position such that the pedals 45 and 46 are in easy reach of the patient's feet. The shoes on the patient's feet are clamped to the appropriate skate mounts 45 and 46 by virtue of the clamping members 49 and 50, respectively, which retain the toe portion of the shoe and by virtue of the strap means 52 which wrap around the patient's ankle to thereby fully secure the patient's feet in the mounts. The patient is arranged such that his knees will have a slight bend in them when either of the pedals 45 and 46 are furthest from the patient.

After securing the paraplegic patient's feet within the pedal assemblies 45 and 46, the human operator then assumes the position upon the seat 20 in the conventional manner that one would operate a bicycle. The operator sits upon the seat 20, holding on to the handle bar assembly 25 for stability, and then initiates rotation of the lower sprocket assembly 30 by placing his feet upon the pedals 33 and 34 and pumping them in a conventional bicycle riding technique. Rotation of the first sprocket assembly 30 will in turn rotate the upper sprocket assembly 40 by virtue of the connecting link chain 50. In such manner, the paraplegic patient's feet are then caused to rotate with the upper sprocket assembly 40 in a pattern of motion identical to that as if the patient was pumping or driving a bicycle. Such operation contracts the tendons and muscles of the legs, and to some extent the patient's related musculature, such as those extending into the patient's hips and back.

The present bicycle type of exercising device is preferably employed in connection with a human operator to render the physical therapy for a number of advantageous reasons. For one, the personal care and attention by another human gives the paraplegic patient an assurance that others are interested in him and that this particular form of exercise is desirable and necessary. Generally, it elicits his cooperation much more. Even more important is the fact that the exercise can be more readily tailored to fit the paraplegic patient's needs over any interval of time whether it be for a matter of seconds or minutes. That is, a particular paraplegic patient may find it more desirable to vary the speed of his exercise from moment to moment and accordingly, the human operator can readily sense the needs of the patient and therefore be able to work much closer with him.

On the other hand, when either a human operator is not available, or should the operator desire to temporarily interrupt his assistance, for example, to attend to another patient, then the present exerciser can be placed on automatic operation by operably connecting the electric motor means 62 to a source of electric power, e.g, by a conventional electrical connecting cord (not shown), whereby the motor 52 will drive the sprocket 51 which in turn will cause the link chain 50 to serpentine over the sprocket assemblies 37 and 49 thereby rotating the upper sprocket assembly 40.

FIG. 4 in the drawings depicts another preferred embodiment of the present invention wherein the main frame assembly 60 further comprises the tubular extended portion 61, the upright bedstead portion 62, the upright seat support portion 63, and the upright floor support portion 64. The support portion 64 further comprises the extended floor legs 64 which form a tripod stucture upon which the present device is mainly supported. The ribs 66 and 67 are provided for strengthening the structure, the tubular frame assembly 60 being fabricated similar to the techniques employed in the construction of a conventional bicycle. The top portion of the present exerciser device is in turn operably connected to and supported upon the top edge of the bedstead or footboard 68 by virtue of the U-shaped clamping device 69. The clamp 69 further comprises the pair of hand clamps 70 and 71 which operates in the conventional manner, for example as the screw incorporated in a common vice. The resilient means 72 are provided within the inside surface of the U-shaped clamp 69 so as to prevent marring of the bedstead 68. The clamping member 69 is rigidly connected to the upright member 62, for example by welding, since these members are some times subjected to a considerable moment.

The seat means 73, whereon a human operator positions himself, is adjustably connected to the upright members 63 of the frame assembly 60, the seat 73 being a conventional bicycle seat connected to the tubular portions 63 in the normal manner as employed in the bicycle arts, that is, by bayoneting the shaft portions 74 into the top sleeve portion of the member 63, that portion being slotted at the top whereby it may be contracted by virtue of the clamping action of the bolt 75 upon it being tightened. The seat 73 is also adjustable in the horizontal plane in the conventional manner.

The frame assembly 60 is provided with the lower sprocket hub bushing 76 as well as the upper sprocket hub portion 77. These portions are bored to rotatably receive the lower sprocket assembly 80 and the upper sprocket assembly 90, respectively.

The lower sprocket assembly 80 further comprises the member 81 which is rotatably mounted within the hub 76, preferably in the manner well known in the bicycle arts utilizing a pair of opposing ball bearing assemblies to thereby minimize friction and require less work input by the operator. The pedal assemblies 82 and 83 are rotatably mounted to the opposing end terminals of the pedal bar 81 in the same manner as that of the embodiment of FIG. 1 discussed in detail above, especially with reference to FIG. 2. The lower sprocket assembly 80 is also provided with the sprocket portion 84 which is centrally mounted thereon. The upper sprocket assembly 90 is essentially identical to that of the embodiment of FIG. 1 as shown and described in detail with regards to FIG. 3. The sprocket assembly 90 further comprises the pedal shaft 91 which is similarly rotatably mounted within the hub portions 77 of the frame assembly 60. The pedal members 92 and 93 are rotatably mounted on the terminal ends of the pedal bar 91 in an identical manner as that described supra with regard to the embodiment of FIG. 1. Likewise, the foot rests or skate mounts 94 and 95 are rigidly attached to the respective pedal members 92 and 93. The clamping devices 96 (only one shown), together with the strap means 97 and 98 form the identical function as described above. The link chain assembly 99 operably connects the sprocket assemblies 80 and 90 together. The auxiliary electric motor drive assembly 100 is interconnected in the chain link assembly to provide an auxiliary source of power where it is desired to administer physical therapy to a paraplegic patient in the absence of a human operator. The electric motor drive assembly 1 further comprises the sprocket member 101 which is rotatably mounted and connected to the elongated frame portion 61 by virtue of the support or gudgeon 102 via the mounting pin or shaft 103, the former being bored to recieve the latter. The gudgeon 102 is in turn welded to or operably connected in some suitable form or fashion to the elongated frame member 61. The electric motor 104 is in turn operably connected to and suspended upon the support member 102, being operably connected to the sprocket 101 by any well known gearing means designed to transmit power through a 90° angle, for example, by mitre bevel gears mounted on 90° intersecting axes, spiral bevel gears mounted on 90° intersecting axes (not shown). The auxiliary drive assembly 100 further comprises the idler gear 105 which is rotatably suspended upon and affixed to the frame portion 61 by virtue of the support clamp 106 to which the gear member 105 is rotatably affixed. The purpose of the gear 105 is to provide a minimum degree of wrap around of the link chain 99 over the peripheral teeth of the electric motor drive sprocket 101. Additionally, the idler gear 105 and clamp 106 also provides a means of adjusting the link chain 99 to insure its proper operation as it serpentines over the sprocket gears 84 and 99.

The auxiliary motor drive assembly 100, sprockets 84 and 99, together with the link chain 95 are housed in the chain guard assembly 107 (right hand side shown only).

Figure 5:
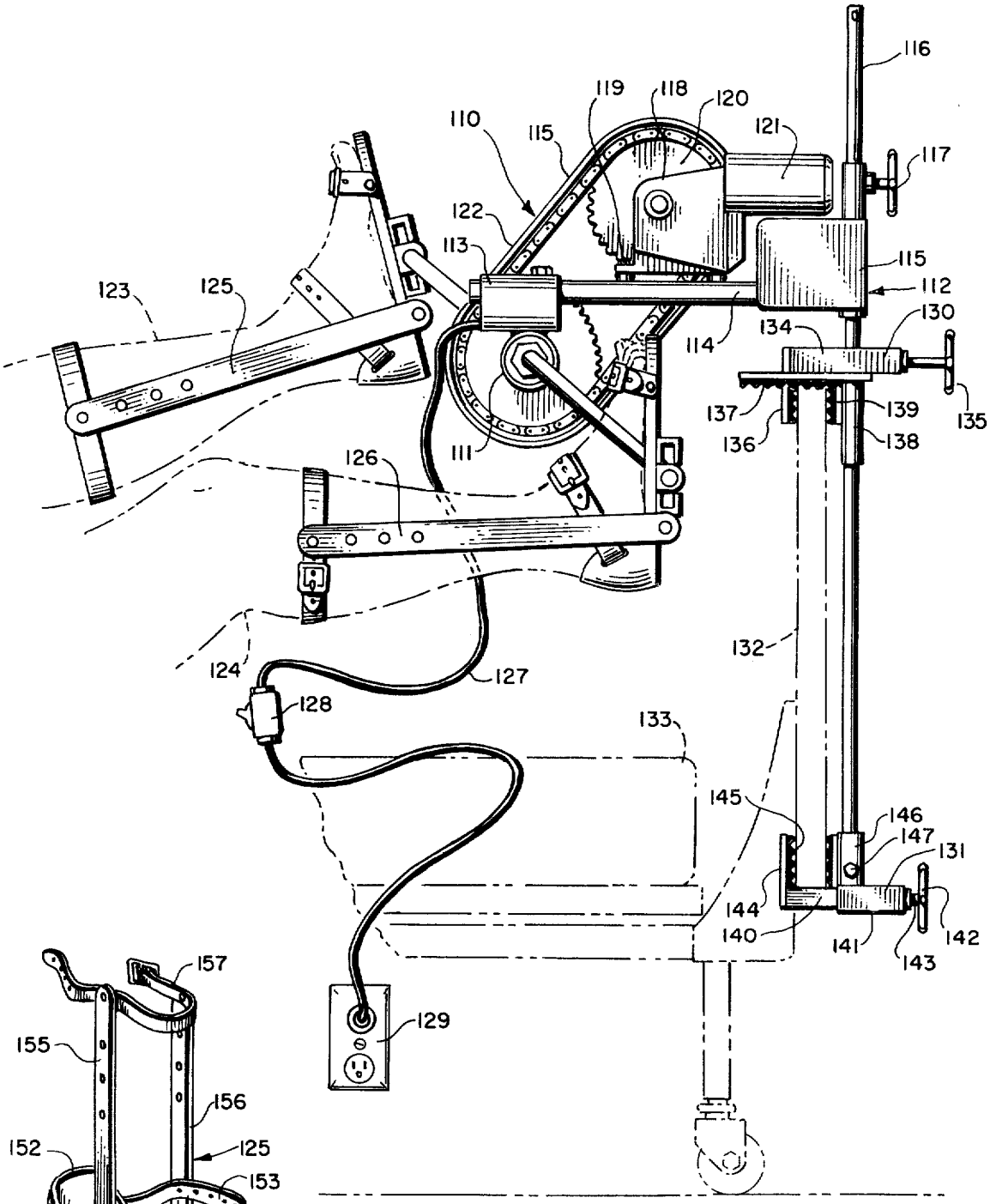
FIG. 5 of the drawings depicts a side elevational view of yet another preferred embodiment of the present invention designed for solely exercising a paraplegic by use of an electrically driven power plant.

Referring to FIG. 5 of the drawings, the exerciser 110 shown represents another preferred embodiment of the present invention. In that embodiment, the sprocket assembly 111 is operably affixed to the adjustable stand assembly 112 through its central hub portion which in turn is affixed to the block member 113 that is in turn bolted to the bar member 114 by virtue of the nut 115. The bar member 114 is in turn rigidly affixed to the support block 115 which is bored to receive the upright tubular support post 116, the screw clamp assembly 117 which is rigidly affixed to the member 115 being provided to allow the vertical adjustment or elevation of the exerciser device 110 to be set depending upon the patient's needs.

The gear reducer assembly 118 which is rigidly affixed to the bar member 114 by virtue of the pedestal and bolt assembly 119, is provided for rotating the second sprocket assembly 120 at a later movement which would be commensurate with the patient's needs, generally at the speeds encountered in motivating a bicycle at slow speed. Needless to say, the device 110 should not be operated at high speeds since the average paraplegic lacks coordination in his legs and considerable injury may result to the patient if he is not able to syncronize or be allowed to attempt to follow the movement of the present device. In fact, one of the purposes of the present device is to give the patient some incentive to exercise his own motor functions and accordingly, if the present device is allowed to exceed in speed the patient's capability to respond, then part of its usefulness will be impaired. Of course, the patient being a paraplegic, by definition is incapable of performing such a bicycle pumping motion, however, any slight assistance that could be mustered in the patient would be beneficial and of therapeudic value.

The gear reducer 118 is operably driven by virtue of the electric gear motor 121 which is operably connected thereto in some suitable form or fashion, such as described hereinabove. The sprocket assemblies 111 and 120 are operably connected to each other by virtue of the interconnecting link chain member 122 which in essence is a conventional bicycle sprocket chain. By such an arrangement, power imparted by the electric motor 121 to the gear box 118 is in turn rotatably transmitted to the sprocket assembly 120 which is rotatably connected to the gear box 118, which rotation in turn is imparted to the sprocket assembly 111 by virtue of the interconnecting sprocket chain 122. This in turn causes the lower sprocket 111 to rotate whereby the patient's legs 123 and 124 which are operably positioned in the foot supporter assemblies 125 and 126 are thereby caused to move in unison with the rotational motion of the sprocket assembly 111.

Electrical power is fed to the electric motor 121 by virtue of the electrical extension cord 127 which extends through the support block 113 and support bar 114. The electrical on-off switch 128 is provided for convenient operation by the patient as well as anybody in attendance of the patient. The electrical lead 127 is plugged into the conventional wall receptical 129 in the conventional fashion.

The upright support bar 116 is operably attached to the adjustable lock assemblies 130 and 131 which in turn are designed as described in detail below so as to be readily mounted upon the bedstead 132 forming part of the bed assembly 133.

The adjustable block assembly 130 further comprises the horizontal screwed member 134 which is acutated by virtue of the handle member 135 whereby the jaw portion 136 can be laterally displaced into contact with the headboard 132. The jaw portion 136 is provided with the soft resilient material 137 in order to prevent marring of the head board 132. The horizontal third portion 130 is in turn rigidly affixed to the vertical sleeve member 138 which is bored to receive the support bar 116 whereby the assembly 130 can be vertically displaced along the length of the bar 116. The sleeve portion 138 in turn is provided with the L-shaped bracket portion 139 which in combination with the jaw member 136 forms a locking structure when affixed upon the headboard 132.

The lower adjustable support 131 in turn further comprises the horizontally adjustable member 140 which bayonets within the sleeve portion 141 upon manipulation of the handle 142 which is mounted upon the stem 143 that in turn is threaded into the horizontal member 140. The member 140 is provided with the upright jaw portion 144 which is likewise provided with the soft resilient material 145 to prevent marring of the headboard 132. The horizontal sleeve portion 141 is provided with the vertical sleeve portion 146 which is bored to receive the vertical support bar 116, being retained therein by virtue of the bolt 147 whereby the support bar 116 and the adjustable support assembly 131 are affixed to each other. By virtue of the lateral jaw adjustments of the assemblies 130 and 131, coupled with the vertical adjustability of the assembly 130, the present device can be readily fitted on most common sizes and designs of hospital bed endboards.

Figure 6:
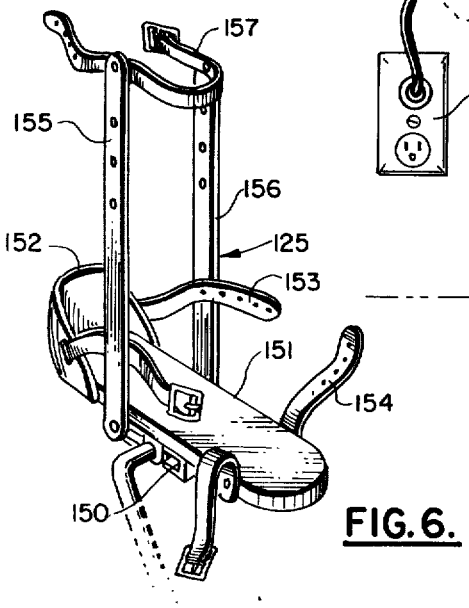
FIG. 6 of the drawings represents an isometric view of a preferred shoe and leg brace assembly for use on the instant device.

FIG. 6 of the drawings illustrates the preferred foot support members referred to in FIG. 5 by reference numerals 125 and 126. For example, the assembly 125 further comprises the sprocket pedal 150 to which is rigidly affixed the foot support member or skate body 151 wherein the patient's foot is placed, being restrained therein by virtue of the heel support member 152 in combination with the ankle strap 153. The strap 154 is adapted to fit over the outer portion of the patient's foot to thereby restrain his foot in the manner depicted in FIG. 5 of the drawings. The upright members 155 and 156 in combination with the upper strap assembly 157 are provided for giving some side support to the patient's leg, primarily due to weakness in the ankle region of the patient since as is well known in the case of a paraplegic, their legs sometimes are exceptionally unstable or wobbly. This structure prevents damage to the patient's bones and/or musculature where they are not able to physically assist in any manner whatsoever the therapy being administered to them by way of the present exercising device.

In any of the above embodiments of the present invention, the conventional skate assembly utilizing a heel support and related straps can be readily replaced with an enclosed plastic shoe assembly wherein the patient's feet can be inserted and the shoe laced up in the conventional fashion, or strapped.

It will be apparent to one skilled in the art that various changes and modifications can be made in the above device as well as in its mode of operation without departing from the true scope and spirit of the present invention. For example, the particular types of structural materials employed in the fabrication of the frame assemblies can be varied, that is, angle iron, channel iron, or similar structural shaped members could be utilized. Moreover, the particular shapes or configurations of the frame assemblies could be varied, as well as the sprocket assemblies and components thereof. Additionally, the materials of construction could vary widely. In light of the above, it is thus apparent to one skilled in the art that many modifications can be made in the instant invention and that what I intend to encompass within the ambit of my invention is that as set forth and particularly pointed out in the appended claims.

I claim:

1. A paraplegic exercising device comprising:

a. frame means having hub portions at both of its ends adapted to receive rotating sprocket means;

b. first sprocket means rotatably mounted in one of the hub portions of said frame means;

c. second sprocket means rotatably mounted in the opposite hub portion of said frame means and adapted to receive the feet of a paraplegic to be administered physical therapy;

d. sprocket connecting means operably connecting said first and second sprocket means together whereby rotation of one sprocket causes the other sprocket to rotate; and e. clamping means operably attached to the end of said frame means provided with said second sprocket means adapted for connection to the feet of a paraplegic to receive physical therapy, said clamping means being further defined in that it is adapted to fit and rest upon the edge of a bed in which the paraplegic is positioned in alignment with said second sprocket means.

2. The paraplegic exercising device of claim 1 further characterized as comprising:

f. auxiliary power means operably connected to said sprocket connecting means.

3. the paraplegic exercising means of claim 2 further characterized as comprising:

g. seat means operably affixed to said frame means in upper alignment with said lower sprocket means.

4. The paraplegic exercising device of claim 3 further characterized as comprising:

h. hand grip means operably attached to said frame means and extending in close proximity to said seat means whereby an operator seated upon said seat means in position for rotation of said first sprocket means by his feet can hold onto said hand grip means to stabilize his position.

* * * * *